US007243712B2

(12) United States Patent
Fay

(10) Patent No.: US 7,243,712 B2
(45) Date of Patent: Jul. 17, 2007

(54) FIN TUBE ASSEMBLY FOR AIR-COOLED CONDENSING SYSTEM AND METHOD OF MAKING SAME

(76) Inventor: H. Peter Fay, 536 S. Granados Ave., Solana Beach, CA (US) 92075

( * ) Notice: Subject to any disclaimer, the term of this patent is extended or adjusted under 35 U.S.C. 154(b) by 112 days.

(21) Appl. No.: 11/255,250

(22) Filed: Oct. 21, 2005

(65) Prior Publication Data

US 2006/0086490 A1 Apr. 27, 2006

Related U.S. Application Data

(60) Provisional application No. 60/621,311, filed on Oct. 21, 2004.

(51) Int. Cl.
*B21D 53/04* (2006.01)
*F28F 1/10* (2006.01)

(52) U.S. Cl. ..... 165/177; 165/153; 29/890.045

(58) Field of Classification Search ..... 165/151–153, 165/177, 179; 29/890.045, 890.046, 890.035
See application file for complete search history.

(56) References Cited

U.S. PATENT DOCUMENTS

| | | | | |
|---|---|---|---|---|
| 3,229,722 | A | 1/1966 | Kritzer | |
| 3,556,204 | A | 1/1971 | Dehne | |
| 3,612,172 | A | 10/1971 | Dohnt | |
| 3,710,854 | A | 1/1973 | Staub | |
| 3,880,231 | A | 4/1975 | Gauthier | |
| 4,190,102 | A | 2/1980 | Grez | |
| 4,815,296 | A | 3/1989 | Amir | |
| 4,909,309 | A | 3/1990 | Palfalvi et al. | |
| 5,185,925 | A * | 2/1993 | Ryan et al. | 29/890.049 |
| 5,275,233 | A | 1/1994 | Little | |
| 5,323,851 | A | 6/1994 | Abraham | |
| 5,632,329 | A | 5/1997 | Fay | |
| 5,653,281 | A | 8/1997 | Berg et al. | |
| 5,765,629 | A | 6/1998 | Goldsmith et al. | |
| 6,142,223 | A | 11/2000 | Bodas et al. | |
| 6,332,494 | B1 | 12/2001 | Bodas | |

(Continued)

FOREIGN PATENT DOCUMENTS

| | | |
|---|---|---|
| DE | 78 12 373 | 3/1979 |

(Continued)

OTHER PUBLICATIONS

PCT International Search Report, Aug. 3, 2006.

*Primary Examiner*—Teresa J. Walberg
(74) *Attorney, Agent, or Firm*—Gordon & Rees, LLP

(57) ABSTRACT

A fin tube assembly has a core tube of elongated transverse cross-section having rounded leading and trailing sides, opposite flat faces, and opposite open ends for flow through the tube. A plurality of fins project in opposite directions from finned areas of the opposite flat faces. The finned areas terminate short of the rounded sides of the core tube. A first internal rib extends across the interior of the core tube adjacent one rounded side and a second internal rib extends across the interior of the core tube adjacent the opposite rounded side to separate the interior of the core tube into a larger central channel between the ribs and separate side channels between each rib and the adjacent rounded side of the core tube.

34 Claims, 7 Drawing Sheets

U.S. PATENT DOCUMENTS

| | | | | |
|---|---|---|---|---|
| 2003/0196324 | A1* | 10/2003 | Hunt | 29/890.046 |
| 2005/0189096 | A1 | 9/2005 | Wilson et al. | |

FOREIGN PATENT DOCUMENTS

| | | | |
|---|---|---|---|
| EP | 0 617 250 | A2 | 9/1994 |
| EP | 0 780 652 | A2 | 6/1997 |
| EP | 1 356 877 | A | 10/2003 |
| EP | 1 557 627 | A1 | 7/2005 |
| GB | 2 017 894 | A | 10/1979 |
| WO | WO 98/33028 | | 7/1998 |

* cited by examiner

FIN TUBE ASSEMBLY FOR AIR-COOLED CONDENSING SYSTEM AND METHOD OF MAKING SAME

CROSS REFERENCE TO RELATED APPLICATIONS

This application is based on, and claims the benefit of, U.S. Provisional Application No. 60/621,311 filed Oct. 21, 2004, entitled Fin Tube Assembly for Air-Cooled Condensing System and Method of Making Same, which is incorporated herein by reference.

BACKGROUND OF THE INVENTION

The present invention relates generally to air-cooled condensing systems for steam turbine generators, and is particularly concerned with fin tubes which provide the heat transfer surface of such air cooled condensers, and methods of making such fin tubes.

Fin tubes typically comprise a central core tube through which the steam flows, and a plurality of parallel cooling fins projecting outwardly from the core tube. Cooling air is drawn over the fin tubes by a fan, and this causes cooling and condensation of the steam flowing along the core tube. Condensate is collected and returned to the steam cycle. Fin tubes are provided in rows of separate individual fin tubes, or fin tubes which are connected together by brazing or metallurgically joining the ribs of adjacent fin tubes. Alternatively, the fin tube assembly of each section of a condenser may be an integral structure in which a single set of fins extends between each adjacent pair of core tubes, with outwardly projecting fins at the ends of each fin tube section.

The core tube is typically formed from a round tube which is then flattened to form an oval or elongated cross-section. The fins are then metallurgically joined to the flattened opposite surfaces of the core tube. This technique is convenient but does not allow for easy mounting of any internal structure within the fin tube, such as the dividers in the core tubes of U.S. Pat. No. 6,332,494 of Bodas et al.

SUMMARY OF THE INVENTION

It is an object of the present invention to provide a new and improved fin tube assembly for an air-cooled condenser.

It is a further object of the invention to provide a new and improved method of making a fin tube.

According to one aspect of the invention, a fin tube assembly is provided, which comprises a core tube of elongated cross-section having rounded leading and trailing sides, opposite flat faces, and open ends, a plurality of fins projecting from a finned area of each flat face extending across at least the majority of the width of the flat face and terminating short of the rounded sides, a first internal rib extending across the interior of the core tube adjacent one rounded side, and a second internal rib extending across the interior of the core tube adjacent the opposite rounded side, each rib being located outside the finned area of the core tube, and the remainder of the core tube between the ribs being empty and comprising a main condensing chamber.

The ribs effectively create two additional flow channels in each tube, one at the air inlet side of the core tube and the other at the air exit side. Several small holes are incorporated in each rib in the mid-zone of the fin tube. These holes are positioned over a distance extending about one third of the total fin tube length. The holes permit passage of steam between the main center flow section of the core tube and the two side flow channels described above. The flow channels are provided in unfinned regions of the core tube to reduce condensation in these channels.

The fin tube assembly may be used in any type of condensing system, such as K-type or D-type condenser or combination K-D condenser. Opposite ends of the fin tubes, including the side channels, may be connected to a steam input header and to an extraction header, respectively. In a K-D arrangement in which steam is supplied to both ends of the fin tube, one or both side channels may be extraction channels for uncondensed steam and non-condensable such as air.

The integral ribs incorporated in the core tubes serve an important second function which is to buttress the core tubes against vacuum induced collapsing forces. During normal operation the core tubes operate at very high vacuum levels that develop forces that incrementally reduce the width of the core tubes. The accumulation of these deflections can develop significant gaps between fin tube bundles. These gaps create paths for air to bypass the fin tubes and thus reduce the performance of the air-cooled condenser. Previously this bypass has been controlled by installing special air seals between fin tube bundles which was costly and labor intensive. The need for such air seals is precluded through the introduction of the integral ribs incorporated in the core tubes of the current invention by virtue of the fact that they directly react to the vacuum induced forces, and thereby prevent deflection of the core tubes.

The fin tube assembly may comprise a single core tube and associated ribs projecting from the opposite faces of the core tube, a series of core tubes interconnected by integral fins joined at each end to opposing flat faces of adjacent core tubes, or a series of core tubes with adjacent fins joined together. In each case, the internal ribs provide resistance against deflection and collapsing forces.

According to another aspect of the present invention, a method of making a fin tube assembly is provided which comprises the steps of:

- taking first and second rectangular panels of sheet metal having opposite side edges and first and second opposite end edges:
- bending the first strip portion extending alongside a first side edge of each panel approximately perpendicular to the panel to form a perpendicular bent first side portion;
- bending a second strip portion extending alongside the second side edge of each panel to form a curved, 180 degree bend with a free end facing towards the first end of the panel;
- positioning the two panels parallel to one another with the bent first side portion of first panel facing the bent second side edge of the second panel and the bent first side portion of the second panel facing the bent second side edge of the first panel, the second panel being offset downwardly relative to the first panel so that the bent first side portion of the second panel is adjacent the free second side edge of the first panel and the bent first side portion of the first panel is adjacent the second side edge of the second panel;
- moving the two panels towards one another until the bent first side portion of the first panel engages an inner wall of the second panel and the bent first side portion of the second panel engages an inner wall of the first panel, forming an elongate central channel between the bent first side portions of the panels and side channels between each bent first portion of a panel and the respective curved 180 degree bend at the second side of the other panel; and metallurgically joining the second side edge of each panel to an opposing outer portion of the other panel, whereby the perpendicular first side portions of the two panels form integral ribs inside the resultant core tube separating the core tube into a central channel and a side channel on each side of the central channel.

If desired, a series of openings may be formed in each strip portion extending adjacent the first side edge of each panel, prior to bending the strip portion perpendicular to the remainder of the panel. These openings provide for communication of steam and non-condensibles between the main channel and side channels. Flow-blocking tabs may also be provided, if desired, simply by welding tabs of metal of the appropriate dimensions to the outer face of each bent first side portion before the two panels are metallurgically joined together. The tabs will be shaped to correspond to the cross-sectional shape of the side channel, but of slightly smaller dimensions to allow for condensate flow past the tab.

This method of manufacture allows core tubes to be readily formed with integral internal ribs, without the problems of inserting such ribs into a pre-formed core tube. The channels at each end may be made of different sizes if desired, simply by forming larger or smaller curved bent end portions at the second ends of the panels. Fins may be attached to the opposite flat faces of the core tubes to form individual fin tubes, or a bundle of fin tubes may be formed by metallurgically joining the fins of adjacent fin tubes, or by providing integral fins between adjacent fin tubes.

The internal ribs formed integrally in the core tube as in this invention may be used to create additional flow channels if desired. Regardless of whether the resultant channels are used as additional flow channels or extraction channels, the ribs will buttress the tube against vacuum induced forces, thereby maintaining stable fin tube geometry during operation. The flow openings can be readily drilled in the side portion of each panel prior to assembly of the panels to form the core tube.

BRIEF DESCRIPTION OF THE DRAWINGS

The present invention will be better understood from the following detailed description of some exemplary embodiments of the present invention, taken in conjunction with the accompanying drawings, in which like reference numerals refer to like parts, and in which:

FIG. 4A is an enlargement of one end of one of the core tubes of FIG. 4;

DETAILED DESCRIPTION OF THE DRAWINGS

Figure 1:
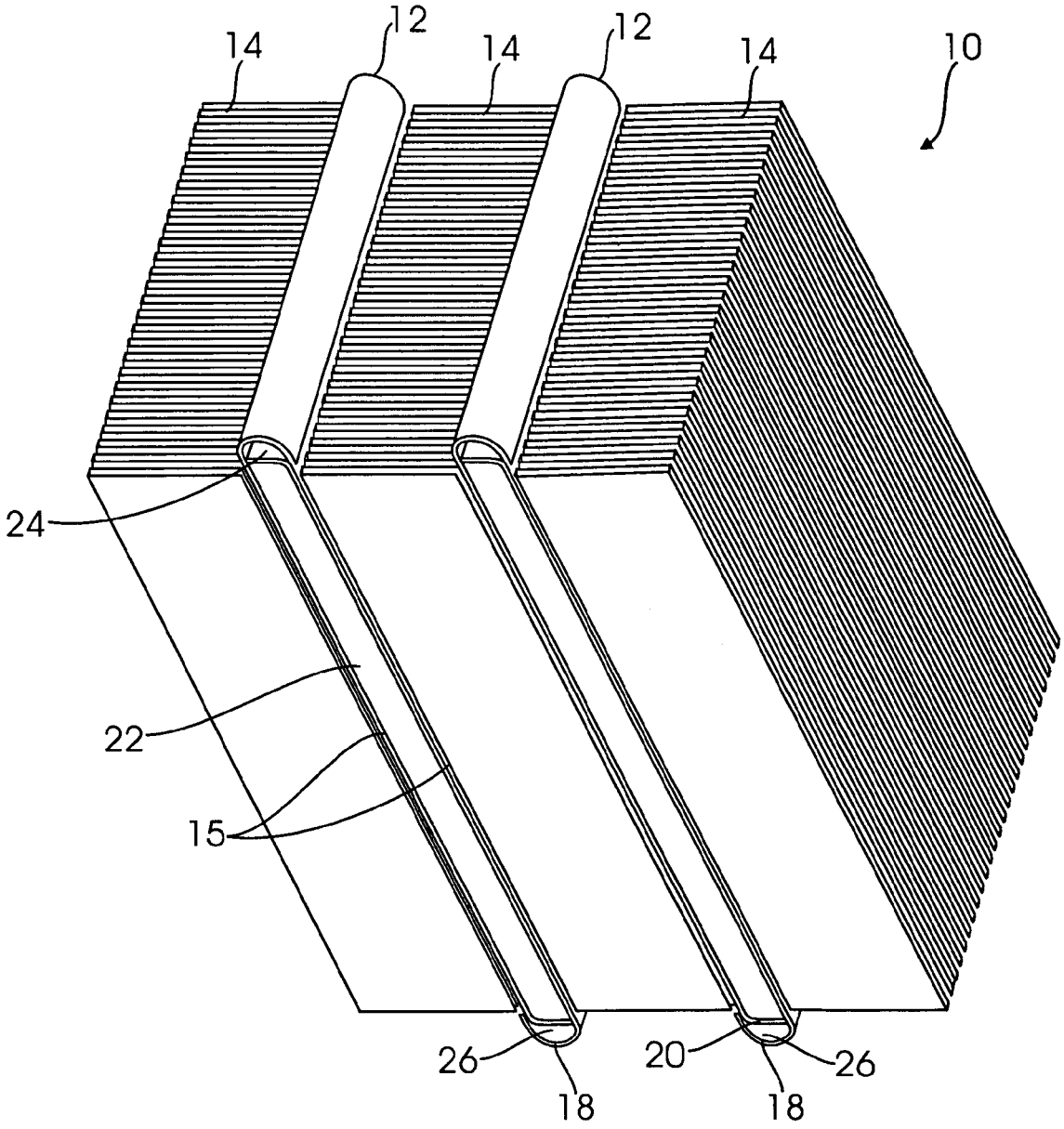
FIG. 1 is a perspective view of a fin tube assembly according to a first embodiment of the invention.
Figure 2:
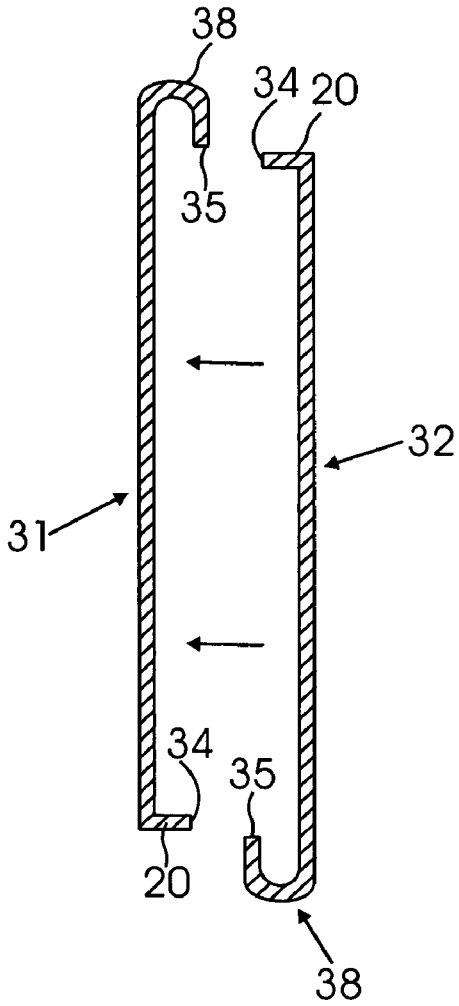
FIG. 2 is a cross-sectional view through two sheet metal panels for forming a core tube of the fin tube assembly of FIG. 1 according to an exemplary method of manufacturing a fin tube according to the invention.
Figure 3:
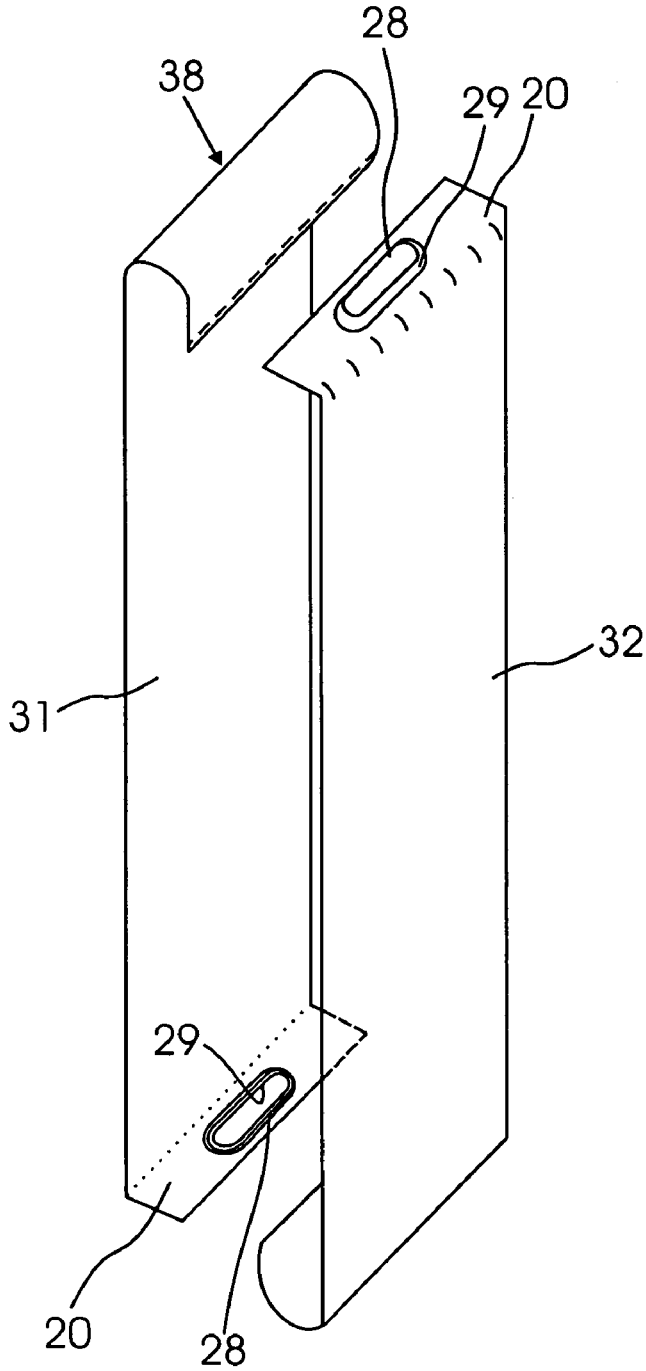
FIG. 3 is a perspective view of a portion of each of the metal panels of FIG. 2 prior to assembly of a core tube from the panels.
Figure 4:
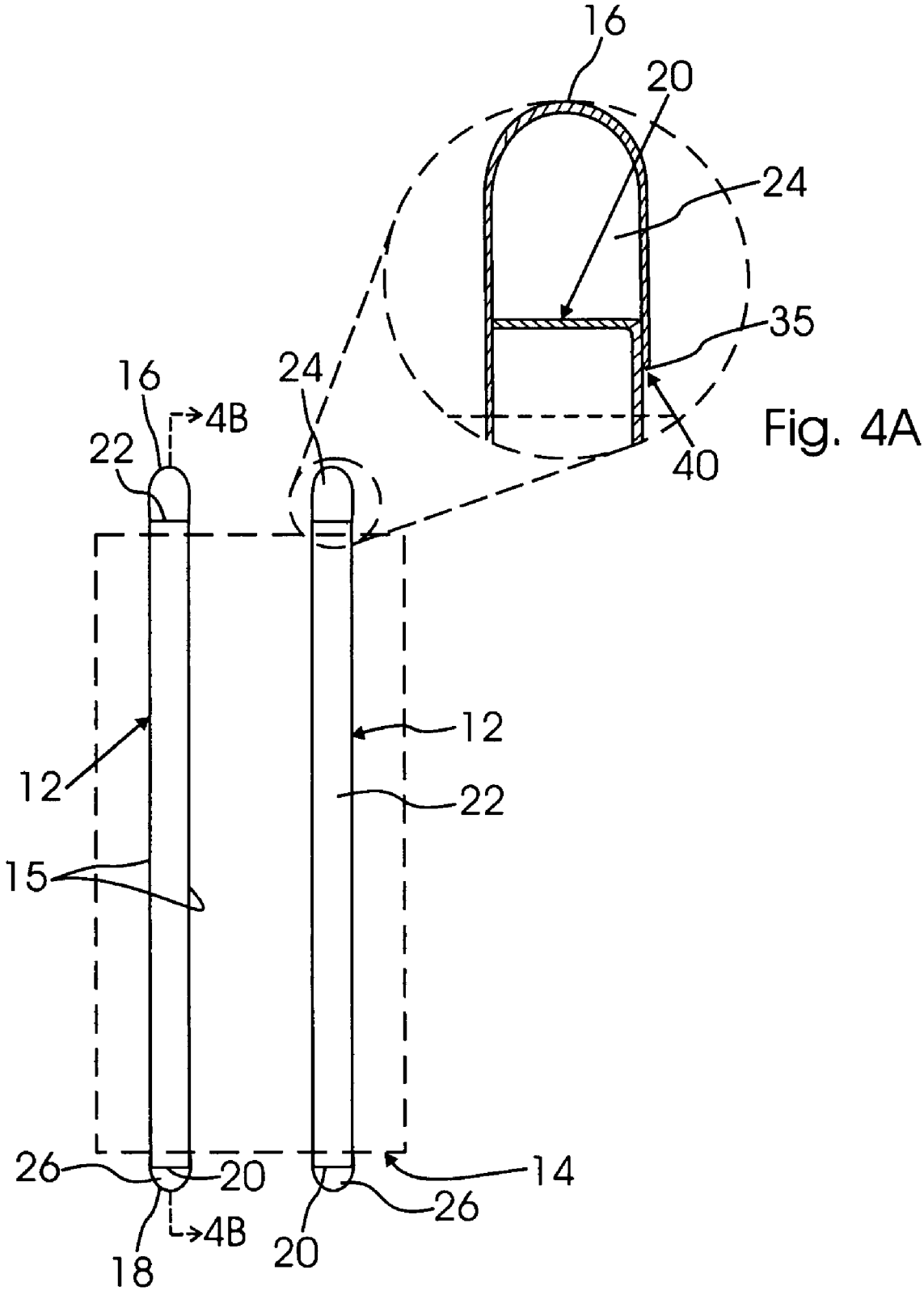
FIG. 4 is a horizontal cross-sectional view through a pair of assembled core tubes.
Figure 5:
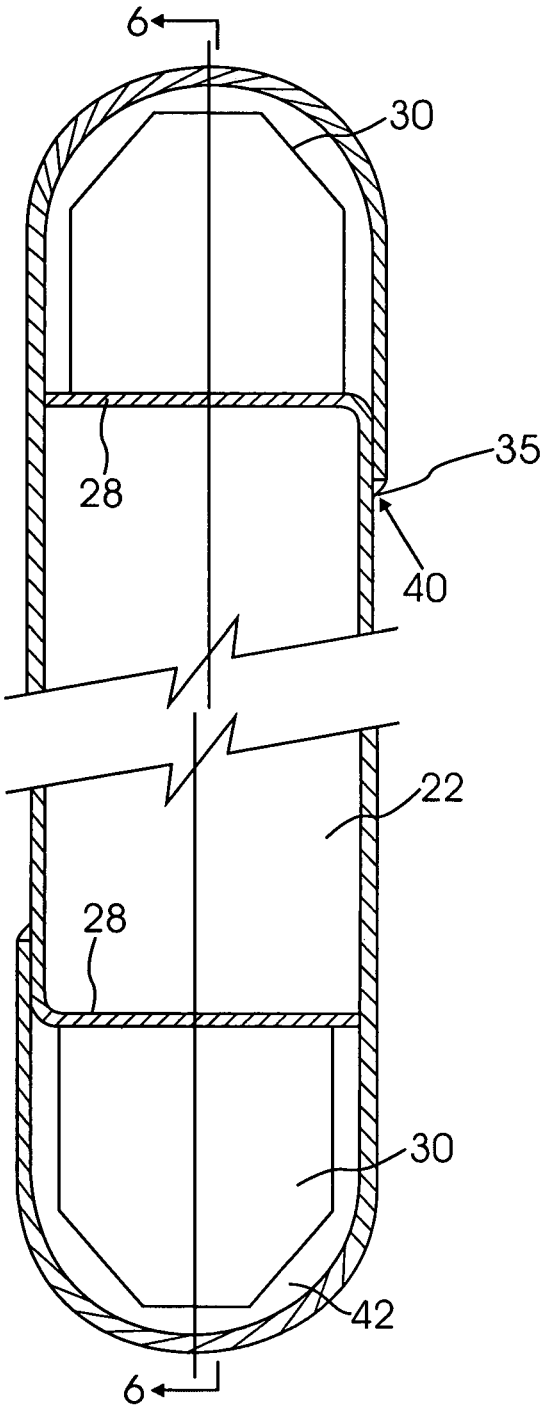
FIG. 5 is an enlarged sectional view of one of the core tubes, broken away to show only the opposite ends of the core tube, with optional flow blocking tabs which may be installed in the tubes.
Figure 6:
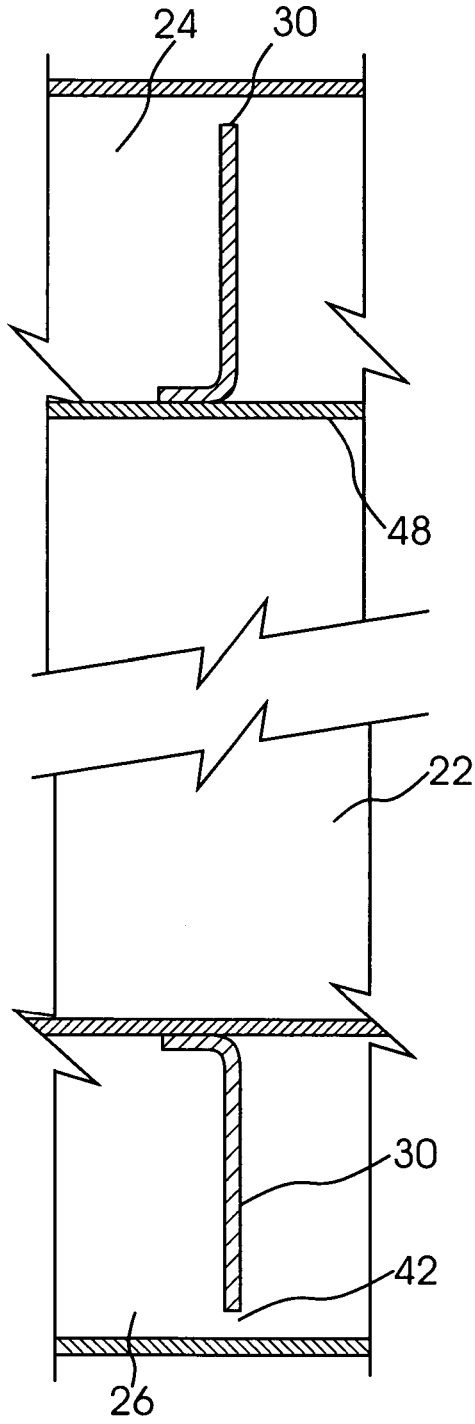
FIG. 6 is a cross section on the lines 6-6 of FIG. 5, also broken away to show the end channels only.

FIG. 1 is a perspective view of a first embodiment of a fin tube assembly 10 according to an exemplary embodiment of the invention, while FIGS. 2 and 3 illustrate how the core tubes 12 of the fin tube assembly may be made according to the method of the invention, and FIGS. 4 to 6 are sectional views of a constructed core tube.

Figure 8:
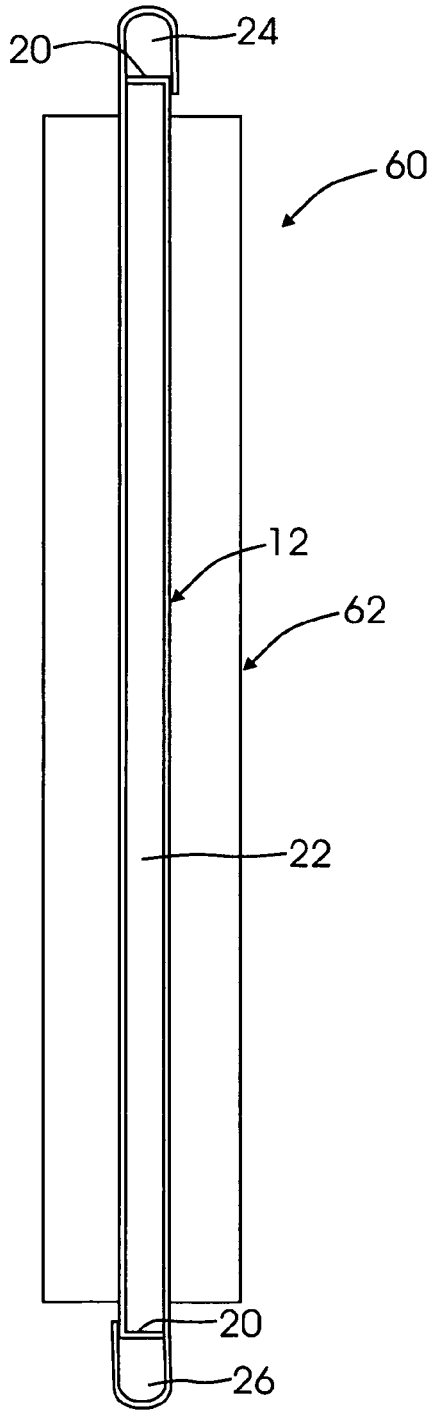
FIG. 8 is a cross-sectional view of a fin tube according to another embodiment of the invention.
Figure 9:
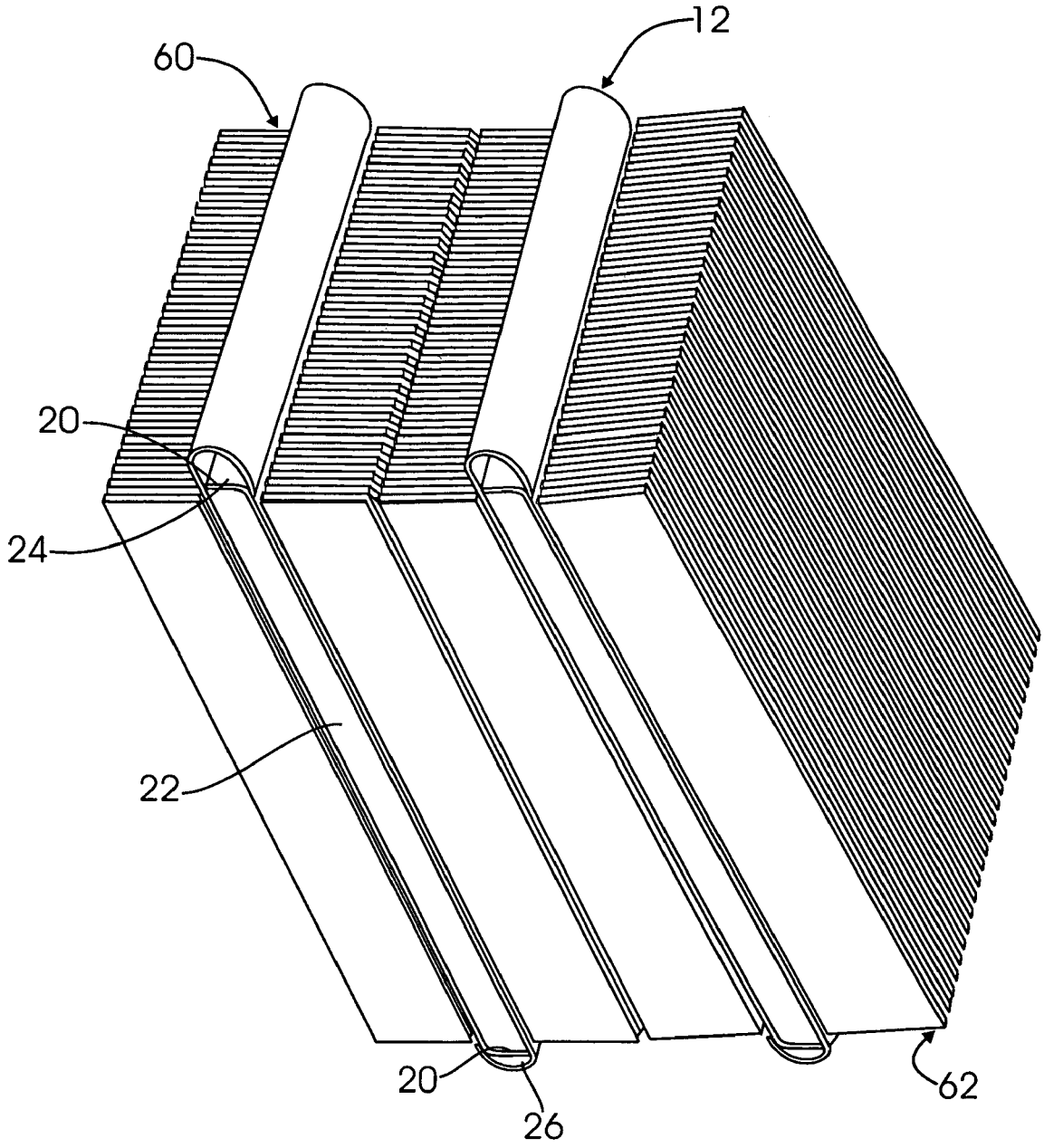
FIG. 9 is a perspective view of two of the separate fin tubes of FIG. 8 arranged side-by-side in a possible condenser arrangement.

The fin tube assembly of FIG. 1 basically comprises a series of core tubes 12, only two of which are seen in FIG. 1, and a series of parallel cooling fins 14 bonded to opposite flat faces 15 of the fin tubes and extending between the tubes. In this embodiment, the fins between adjacent core tubes are formed integrally as a single set of fins, but each fin tube which comprises a core tube and outwardly directed sets of fins may be formed separately, and the fins between adjacent core tubes may be metallurgically joined together at their junction. Alternatively, separate fin tubes may be formed and positioned side by side in a condenser section without joining the adjacent fins, as illustrated in the embodiment of FIGS. 8 and 9.

Figure 4B:
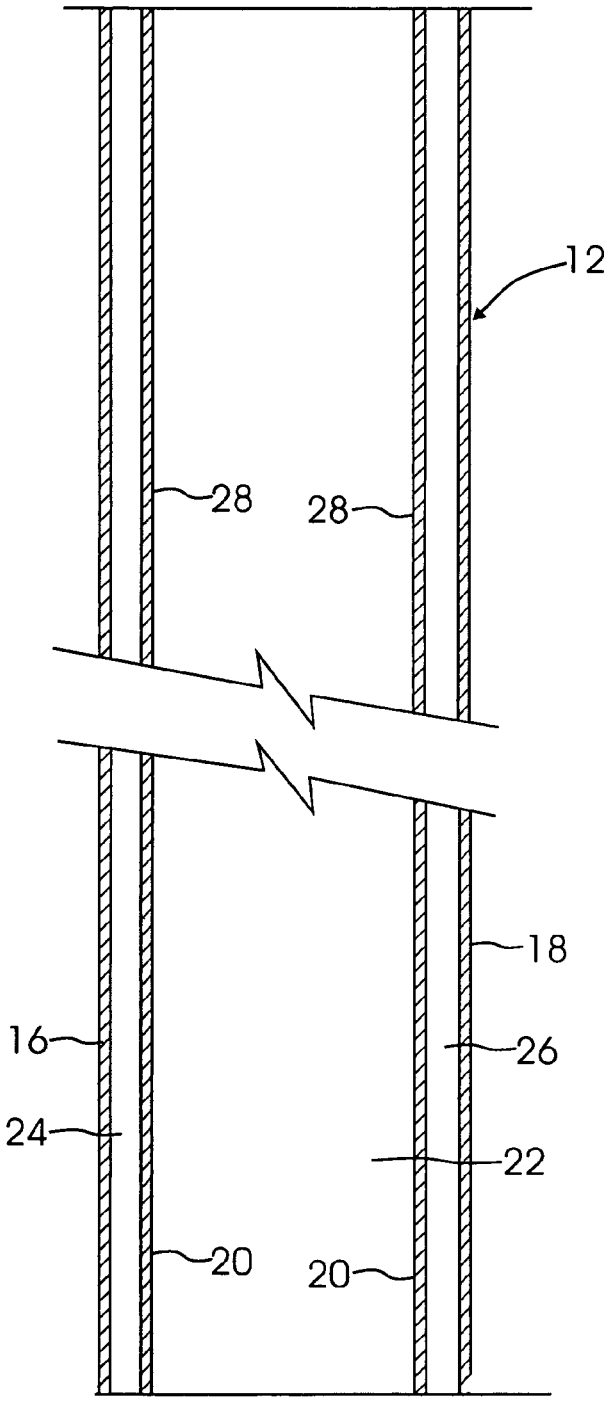
FIG. 4B is a vertical cross-sectional view through a core tube on the lines 4B-4B of FIG. 4.

Each core tube 12 is of elongate, generally rectangular cross-section with rounded or semi-cylindrical opposite sides 16, 18. An internal rib 20 extends between the opposite inner faces of the tube adjacent each rounded side, dividing the tube into a central or main channel 22 and opposite side or auxiliary channels 24, 26. As indicated in FIGS. 1 and 4, the ribs 20 and auxiliary channels 24, 26 are outside the finned area of the core tube. The length of the fins in the airflow direction extends to within 10 mm of the distance between the ribs 20. The airflow direction is indicated by the arrows in FIG. 1 and indicates the flow of cooling air over the fin tubes, as induced by an air moving device such as a fan. As illustrated in FIG. 4B, the channel when formed is open at each longitudinal end, for attachment to suitable headers for steam input or extraction.

The core tubes may be approximately 11 mm to 19 mm wide and the fins have a transverse width of approximately 38 mm, resulting in a fin tube pitch of 49 mm to 57 mm, although these dimensions may be varied to provide a narrower fin tube with longer fins, if desired. The length of the fin tubes is variable but can exceed 10 meters. In order to maintain steam velocities and associated pressure drops within reasonable limits the cross-sectional area of the core tubes must be of appropriate size. Typically this results in core tubes that occupy approximately ⅓ of the heat exchanger's plan area. The fins may be made of aluminum and the core tubes of carbon steel. They are metallically bonded to each other by specialty brazing methods.

In prior art fin tubes, the wall thickness of the core tube had to be at least 1.5 mm for corrosion allowance. Corrosion will occur over time in such core tubes due to the pressure of non-condensibles, principally air. Due to the ribs 20 which buttress the ends of the tube and resist deformations, the core tube walls may be made thinner in this invention, allowing more expensive, corrosion resistant materials to be used for the tube, such as a stainless steel alloy rather than carbon steel. This alloy is more expensive than carbon steel, but the wall thickness can be significantly reduced due to the elimination of the need for corrosion allowance due to the use of corrosion-resistant material. Thus, the overall materials cost will remain approximately the same. The core tube strength will still be sufficient with thinner walls, due to the integral ribs which strengthen the tubes and resist deformation. The ability to supply a thinner wall core tube also increases the available cross-section area of the core tube which reduces steam side pressure drops and increases the efficiency of the condensing procedure.

The auxiliary channels 24, 26 may be used as flow channels along with the main channel 22, and the fin tube assembly may be used in a K condenser section, a D condenser section, or a combined K-D condenser section. The latter arrangement will be the same as described in my co-pending provisional patent application No. 60/621,386 filed on Oct. 21, 2004 and entitled Air-Cooled Condensing System, and the corresponding non-provisional application based on that provisional application which is filed on even date herewith and the contents of which are incorporated herein by reference. The width of the core tubes will be around 11 mm for a K-D condenser section, and around 19 mm for a K or D only condenser section. Optionally, a plurality of openings 28 may be stamped in each rib 20 prior to assembly of the tube, one of which can be seen by way of example in FIG. 3. This allows steam flow between the main channel 22 and end channels 24, 26. The openings 28 may be elongate slots with raised rims 29 as indicated in FIG. 3, or may be stamped flat slots as indicated in FIG. 5, or may be multiple round openings in other cases. Where the openings are elongate slots, the slots extend in the direction of steam flow through the core tube. The location and sizes of the openings is dependent on the type of condenser and the manner in which the end channels are to be used.

In one example of a K-D condenser section using the fin tubes 10, one or both side or auxiliary channels may be used as extraction channels for extracting steam and non-condensibles from the main channel 22 and conveying the extracted steam and non-condensibles to a subsequent stage. Where only one channel is used for extraction, this will be the channel 24 at the trailing edge 16 the core tube, i.e. the end which faces away from the cooling air flow indicated by the arrows in FIG. 4B, where the air is considerably warmer than on the leading edge 18. In a combined K and D condenser, steam is fed into both the upper and lower end of the condenser. The steam will flow in opposite directions along the main channel 22 (and along the channels 24, 26 if these are open at both ends) and any uncondensed steam in the opposing flows will meet approximately in the central region of the core tube. Therefore, openings between the main channel and auxiliary channels will be provided in the central third portion of the ribs 20. If both auxiliary channels 24 and 26 are used for extraction of steam and non-condensibles, they may be connected at their upper ends to an extraction header, which is in turn connected to a second stage condenser. Where only the downstream or trailing edge channel 24 is used for extraction, the upper end of this channel alone may be connected to the second stage condenser. Alternatively, one or more extraction ports may be connected to channel 24 in the central region of the channel, and the port or ports may be connected by suitable ducting to a second stage condenser.

In this embodiment, the extraction channel may be connected at its lower end to a steam header, as is the main channel, and the core tubes in this case may be constructed with flow blocking tabs 30 which project inwardly from each rib into the respective channel 24, 26, as best illustrated in FIGS. 5 and 6, at a location approximately one third of the length of the channel from its lower end. In one example, three elongate slots 28 are provided at spaced intervals in the central one third section of each rib above the flow blocking tab 30, and one or two slots may also be provided below each tab for steam flow from the auxiliary channel to the main channel 22. A greater or lesser number of slots may be provided in other embodiments. The flow blocking tab 30 restricts the flow of steam upwardly through the extraction channel, while being spaced from the inner walls of the channel so that any condensate formed in the upper portion of the extraction channel can flow downwardly around it.

It will be understood that the channels in the core tube will be connected differently for different types of condensers. For example, the channels 24, 26 may be employed as auxiliary condensing channels connected to steam input and extraction headers in the same way as the main channel 22. In the latter case, a plurality of openings may be provided along the length of each rib.

FIGS. 2 to 6 illustrate the method of making the core tube 12 according to an exemplary embodiment of the invention. As illustrated in FIGS. 2 and 3, the core tube 12 is formed from two identical sheet metal pieces or panels 31, 32 which are initially flat and of appropriate dimensions to form a core tube of the desired dimensions. FIG. 3 shows only a portion of the respective sheet metal pieces, which will have a length of the order of 10 meters as noted above, to illustrate how they are formed prior to attaching them together. Each sheet metal panel has opposite end edges (not visible in the drawings) and opposite, first and second side edges 34, 35. A side portion or strip adjacent the first side edge 34 is bent perpendicular to the remainder of the sheet metal piece or panel to form a rib 20, and a wider side portion adjacent the second end edge 35 is bent through 180 degrees to form a rounded portion or semi-cylindrical bend 38.

The two panels 31, 32 are then positioned as illustrated in FIG. 2 such that the perpendicular portion or rib 20 at one side edge of the first panel 31 faces towards the rounded portion 38 of the second panel 32, and the rounded portion 38 of the first panel faces the perpendicular rib 20 of the second panel. The two panels are offset so that the second panel is offset downwardly relative to the first panel as viewed in FIG. 1. The panels are then brought together in the direction of the arrows in FIG. 2 until the first side edges 34 of each panel contact the opposing inner wall portion of the other panel, and the second panel 32 is then moved upwardly as viewed in FIG. 2 until the edge 35 of each rounded portion 38 overlaps the flat outer surface of the other panel (see FIGS. 4A and 5). The two panels are then joined by welding, brazing or the like 40 along each side edge 34 to form a single core tube 36 as shown in FIGS. 4, 4A and 5. This method produces a core tube with integral ribs. The cooling fins 14 can then be metallurgically joined to the outer flat faces 15 of the core tube 12.

Any desired openings 28 in the ribs which separate the resultant main channel 22 from the side channels 24 and 26 can be easily stamped in the appropriate positions in the first side edge portion which forms rib 20 prior to bending that side edge portion into the configuration illustrated in FIGS. 2 and 3. If a flow blocking tab 30 is required, a suitable piece of metal is stamped to follow the contour of the cross-section of a side channel 24 or 26, and is then welded at the appropriate position along the outer face of rib 20 of one panel prior to attachment to the other panel. The tab is of appropriate size such that a condensate drainage gap 42 is provided around its perimeter, as indicated in FIGS. 5 and 6.

Figure 7:
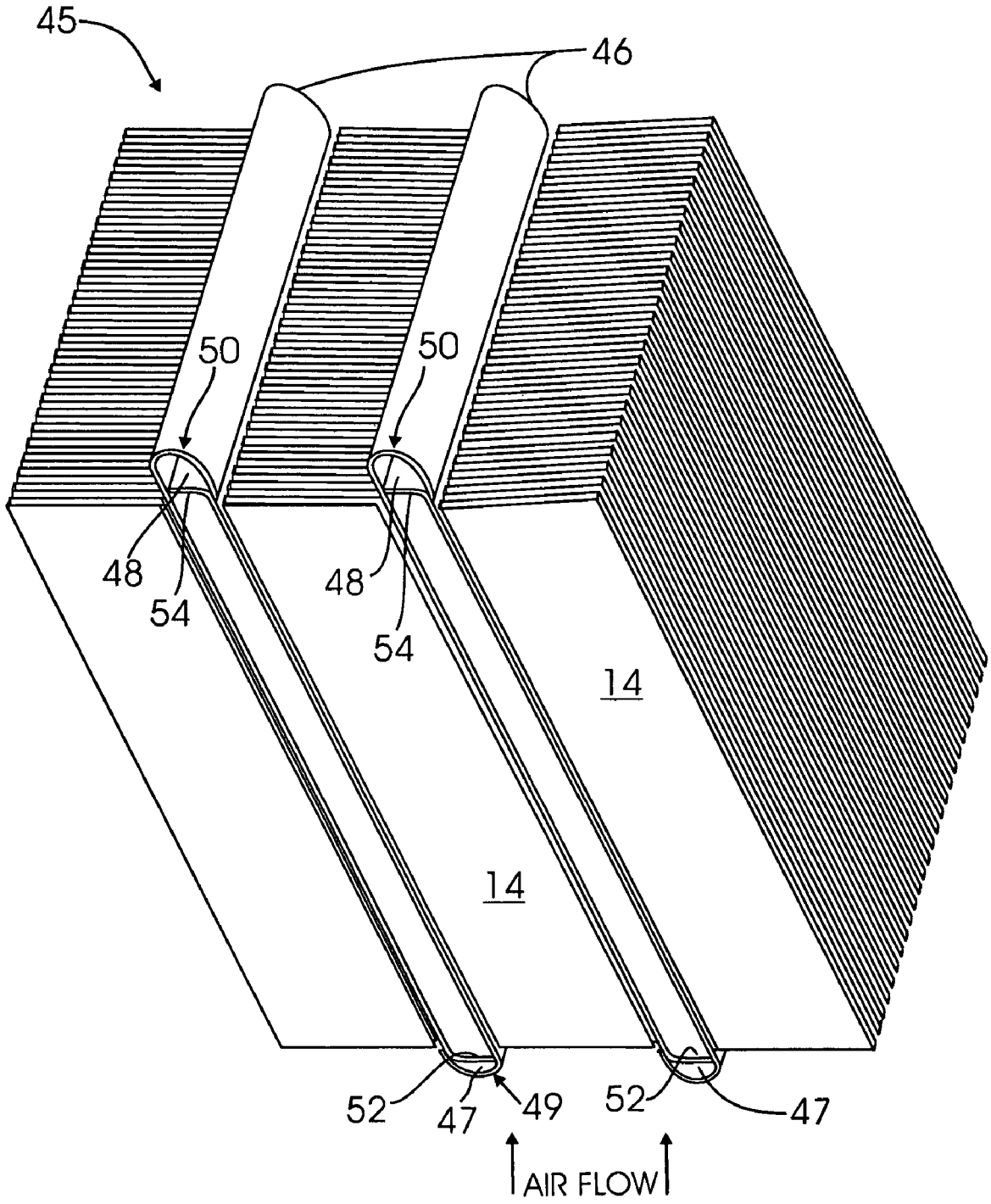
FIG. 7 is a perspective view similar to FIG. 1 illustrating a modified fin tube assembly according to another embodiment of the invention.

The size of the side channels can be readily adjusted in manufacture simply by making the bent end portions of each panel 31, 32 longer or shorter. FIG. 7 illustrates a fin tube assembly 45 of an alternative embodiment in which the core tubes 46 are modified to have side channels 47, 48 of different sizes. The side channel 47 which faces the air flow direction in the assembled fin tube is made smaller and the opposite side channel 48 on the trailing edge of the core tube 46 is larger. This is achieved by making the first rounded end portion 49 of one of the two panels relatively short, and elongating the second rounded end portion 50 of the second panel. When the two panels are welded together in the same way as described above, a first rib 52 will be closer to the first rounded portion 49, and a second rib 54 will be farther away from the second rounded portion 50, making a larger trailing edge channel 48. Integral cooling fins 14 extend between the flat faces of the core tubes 46, as in the first embodiment, and the fins terminate just short of each rib.

In this embodiment, the larger channel 48 on the trailing edge of the core tube can be used as an extraction channel for steam and non-condensibles. The channel 48 may be approximately double the size of the equivalent channel 24 in the first embodiment, although the cross-sectional area may be adjusted as necessary. Similarly, the smaller channel may be around half the cross-sectional area of the equivalent channel 26 in the first embodiment. If the condenser is set up as a combination K and D condenser, appropriate openings will be provided in the central one third region of the ribs 54 for flow of steam and non-condensibles from the main channel 22 into the extraction channel 48, and appropriate ducting will be provided for conveying the steam and non-condensible mixture to ejection equipment or a subsequent condenser stage. The smaller channel 47 on the leading edge may be open at both ends to act as an auxiliary condensing channel with main channel 22, and communication openings will be provided along the length of rib 52.

FIG. 8 illustrates a modified fin tube 60 according to another embodiment of the invention. The fin tube 60 has a core tube 12 constructed in exactly the same way as the first embodiment, and like reference numerals have been used for like parts as appropriate. The main difference between fin tube 60 and the fin tube assembly 10 of FIG. 1 is that fin tube 60 has independent fins 62 projecting from each flat face of the core tube 12 to form a single, stand-alone fin tube, rather than an integrated fin tube assembly with common fins 14 as in FIG. 1. In an air-cooled condenser installation, a plurality of single fin tubes 60 will be arranged side by side to form a condenser section, with small gaps between the outer ends of the fins between adjacent tubes, as indicated in FIG. 9 for two such fin tubes.

The fin tube structure and method of manufacture of this invention allows integral internal ribs to be readily incorporated at opposite sides of the main channel in the core tube. The ribs effectively create two additional flow channels in each tube, one at the air inlet side of the core tube and the other at the air exit side. Several small holes may be incorporated in each rib in the mid-zone of the fin tube, as discussed above. These holes are positioned over a distance extending about one third of the total fin tube length. The holes permit passage of steam between the main center flow section of the core tube and the two side flow channels described above. The flow channels are provided in unfinned regions of the core tube to reduce condensation in these channels.

The core tube in each of the above embodiments is simple to make from only two panels of sheet metal which are appropriately shaped at each side edge to form a rib at one edge and a rounded bend at the opposite edge, and then brought together and welded along the edge of the rounded portion on each side of the tube. In addition to creating additional channels at the leading and trailing sides of the core tube, the ribs will strengthen the core tube and resist deflection due to vacuum forces, in addition to reducing stress along the opposite sides of the tube. This allows the core tube to potentially be manufactured from a corrosion-resistant alloy rather than the usual carbon-steel, avoiding the need for built-in corrosion allowance in the tube wall thickness. The walls can then be made thinner, so that the core tube material costs will be similar to those for a core tube made from less expensive carbon-steel alloy, while also increasing the available cross-sectional area of the core tube for steam flow.

Although some preferred embodiments of the invention have been described above by way of example only, it will be understood by those skilled in the field that modifications may be made to the disclosed embodiments without departing from the scope of the invention, which is defined by the appended claims.

I claim:

1. A fin tube assembly for an air-cooled condenser, comprising:

a core tube of elongated transverse cross-section having rounded leading and trailing sides, opposite flat faces, and open ends;

a plurality of spaced, parallel fins projecting from a finned area of each flat face, the finned area extending across at least the majority of the width of the flat face and terminating short of the rounded sides;

a first internal rib extending across the interior of the core tube adjacent one rounded side and a second internal rib extending across the interior of the core tube adjacent the opposite rounded side to separate the interior of the core tube into a larger central channel between the ribs and separate side channels between each rib and the adjacent rounded side of the core tube; and each rib being located outside the finned area of the core tube.

2. The assembly as claimed in claim 1, wherein the core tube has a central region spaced from its open ends, and at least one of the ribs has a plurality of holes located in the central region of the core tube.

3. The assembly as claimed in claim 2, wherein both ribs have a plurality of holes located in the central region of the core tube.

4. The assembly as claimed in claim 2, wherein the holes are located at spaced intervals over a distance extending about one third of the total fin tube length.

5. The assembly as claimed in claim 2, wherein the holes comprise elongate slots having longitudinal axes which extend in a flow direction between opposite open ends of the core tube.

6. The assembly as claimed in claim 5, wherein the slots have raised rims projecting inwardly from the rib into the side channel.

7. The assembly as claimed in claim 3, wherein the holes in one of the ribs have raised rims projecting into the respective side channel, and the holes in the other rib have flat rims on both faces of the rib.

8. The assembly as claimed in claim 1, further comprising at least one flow blocking tab extending across the majority of the cross-sectional area of each side channel.

9. The assembly as claimed in claim 8, wherein the flow blocking tabs are located closer to one open end of the core tube than the other open end.

10. The assembly as claimed in claim 8, wherein each flow blocking tab is secured to the respective rib and projects from the rib across part of the cross sectional area of the side channel, the flow blocking tab having a peripheral edge spaced from the opposing inner surface of the side channel to leave a gap for restricted fluid flow past the tab.

11. The assembly as claimed in claim 1, wherein the side channels are of the same dimensions.

12. The assembly as claimed in claim 1, wherein one of the channels has a first cross-sectional area and the other channel has a second cross-sectional area smaller than the first cross-sectional area.

13. The assembly as claimed in claim 12, wherein the second cross-sectional area is approximately half of the first cross-sectional area.

14. The assembly as claimed in claim 1, wherein the transverse width of the core tube between the opposite flat sides is in the range from approximately 11 mm to approximately 19 mm.

15. The assembly as claimed in claim 14, wherein the fins have a height of approximately 48 mm.

16. The assembly as claimed in claim 1, wherein the fin tube pitch is in the range of approximately 49 mm to 57 mm.

17. The assembly as claimed in claim 1, wherein the core tube is made from stainless steel alloy.

18. A fin tube assembly for an air-cooled condensing system, comprising:

a plurality of core tubes extending parallel to one another at spaced intervals, each core tube having opposite open ends and being of elongate transverse cross section with opposite flat faces and rounded leading and trailing sides, the leading edge facing in the direction of a cooling air flow across the fin tube assembly and the trailing edge facing away from the cooling air flow, each flat face having a fin area extending over at least substantially the entire area of said flat face, the fin area terminating short of the rounded leading and trailing sides of the core tube;

a plurality of spaced, parallel fins projecting outwardly from each of the fin areas of each core tube;

a first internal rib extending across the interior of each core tube at a location outside the fin area so as to form a separate first side chamber between the first internal rib and the adjacent rounded side of the core tube;

a second internal rib extending across the interior of each core tube at a location outside the fin area so as to form a separate second side chamber between the second internal rib and the adjacent rounded side of the core tube; and the space between the first and second ribs of each core tube comprising a main condensing chamber.

19. The assembly as claimed in claim 18, wherein at least one of the ribs has openings for flow between the main condensing chamber and respective side chamber.

20. The assembly as claimed in claim 19, wherein the other rib has openings for flow between the main condensing chamber and the other side chamber.

21. The assembly as claimed in claim 20, wherein the openings are all located in a central portion of the respective rib between the opposite open ends of the core tube, the central portion extending for a length equal to approximately one third of the total length of the core tube between its opposite open ends.

22. The assembly as claimed in claim 18, wherein the fins extending between each adjacent pair of core tubes are formed integrally.

23. The assembly as claimed in claim 18, wherein the fins extending between each adjacent pair of core tubes are joined together at their adjacent ends.

24. The assembly as claimed in claim 18, wherein the fins on each core tube have outer free ends and adjacent core tubes are placed side by side with gaps between the outer free ends of the fins of adjacent core tubes.

25. The assembly as claimed in claim 18, further comprising a steam input header connected to a first open end of each core tube.

26. The assembly as claimed in claim 25, wherein the first end of each core tube is the upper end and an extraction header is connected to the second, lower end of each core tube, whereby the fin tube assembly forms a K-type condenser.

27. The assembly as claimed in claim 25, wherein the first end of each core tube is the lower end and an extraction header is connected to the second, upper end of each core tube, whereby the fin tube assembly forms a D-type condenser.

28. The assembly as claimed in claim 25, wherein the steam input header is also connected to the opposite, second open end of each core tube, whereby the fin tube assembly forms a combined K-D condenser, and an extraction header is connected to at least one of the side channels.

29. The assembly as claimed in claim 25, wherein both side channels comprise extraction channels for conveying uncondensed steam and non-condensibles from the main condensing chamber.

30. A method of making a fin tube assembly for an air-cooled condenser, comprising the steps of:

taking first and second rectangular panels of sheet metal having opposite side edges and first and second opposite end edges:

bending a first strip portion extending alongside a first side edge of each panel approximately perpendicular to the panel to form a perpendicular bent first side portion;

bending a second strip portion extending alongside a second side edge of each panel to form a second side portion having a curved, 180 degree bend with a free end facing towards the first end of the panel;

positioning the two panels parallel to one another with the bent first side portion of first panel facing the bent second side portion of the second panel and the bent first side portion of the second panel facing the bent second side portion of the first panel, the second panel being offset downwardly relative to the first panel so that the bent first side portion of the second panel is adjacent the free second side edge of the first panel and the bent first side portion of the first panel is adjacent the second side edge of the second panel;

moving the two panels towards one another until the bent first side portion of the first panel engages an inner wall of the second panel and the bent first side portion of the second panel engages an inner wall of the first panel, forming an elongate central channel between the bent first side portions of the panels and side channels between each bent first portion of a panel and the respective curved 180 degree bend at the second side of the other panel; and attaching the second side edge of each panel to an opposing outer portion of the other panel, whereby the perpendicular first side portions of the two panels form integral ribs inside the resultant core tube separating the core tube into a central channel and a side channel on each side of the central channel.

31. The method as claimed in claim 30, further comprising the step of forming a series of openings in each first strip portion prior to bending said strip portions and securing said panels together, the openings providing communication between the central channel and side channels.

32. The method as claimed in claim 30, further comprising the step of securing a flow blocking tab to an outer face of each bent first side portion prior to securing the panels together, the tab projecting transverse to said first side portion and having a shape corresponding to the cross-sectional shape of the side channel and of slightly smaller dimensions than the cross-sectional dimensions of the side channel, whereby a gap is provided between the tab and inner surface of the respective bent second side portion when the panels are secured together.

33. The method as claimed in claim 30, wherein the bent second side portion in one of said panels is formed to be of larger dimensions than the bent second side portion of the other of said panels, whereby the formed side channels are of different dimensions.

34. The method as claimed in claim 30, wherein the bent second side portions in each panel are of substantially identical dimensions, whereby the two side channels are of substantially identical sizes.

* * * * *